US009188049B2

(12) United States Patent
Iwata et al.

(10) Patent No.: US 9,188,049 B2
(45) Date of Patent: Nov. 17, 2015

(54) EXHAUST DEVICE FOR MOTORCYCLE

(71) Applicant: HONDA MOTOR CO., LTD., Tokyo (JP)

(72) Inventors: Masayuki Iwata, Wako (JP); Ryosuke Kinoshita, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/285,040

(22) Filed: May 22, 2014

(65) Prior Publication Data

US 2014/0352288 A1 Dec. 4, 2014

(30) Foreign Application Priority Data

May 31, 2013 (JP) ..... 2013-115870

(51) Int. Cl.
*F01N 1/00* (2006.01)
*F01N 13/10* (2010.01)
*F01N 13/18* (2010.01)

(52) U.S. Cl.
CPC ..... *F01N 13/10* (2013.01); *F01N 13/1888* (2013.01); *F01N 2590/04* (2013.01)

(58) Field of Classification Search
CPC .. F01N 13/10; F01N 13/1888; F01N 2590/04
USPC ..... 60/323, 324
See application file for complete search history.

(56) References Cited

U.S. PATENT DOCUMENTS

| | | | | |
|---|---|---|---|---|
| 6,283,162 | B1 | 9/2001 | Butler | |
| 6,478,340 | B1 | 11/2002 | Butler | |
| 6,634,171 | B1 * | 10/2003 | Banks, III | 60/313 |
| 2002/0166720 | A1 * | 11/2002 | Kusabiraki et al. | 181/240 |
| 2005/0115765 | A1 * | 6/2005 | Minato | 181/240 |
| 2007/0119158 | A1 * | 5/2007 | Yoshida et al. | 60/321 |
| 2008/0110162 | A1 * | 5/2008 | Arai | 60/323 |
| 2009/0000286 | A1 * | 1/2009 | Aoki et al. | 60/323 |
| 2010/0011755 | A1 * | 1/2010 | Okamoto | 60/323 |
| 2010/0126157 | A1 * | 5/2010 | Murakami et al. | 60/323 |
| 2010/0126158 | A1 * | 5/2010 | Murakami et al. | 60/323 |
| 2011/0016859 | A1 * | 1/2011 | Schumnig | 60/323 |

FOREIGN PATENT DOCUMENTS

| | | |
|---|---|---|
| EP | 0312251 | 4/1989 |
| EP | 1538315 | 6/2005 |
| EP | 1793101 | 6/2007 |
| JP | 62-731 | 1/1987 |

* cited by examiner

*Primary Examiner* — Jason Shanske
(74) *Attorney, Agent, or Firm* — Rankin, Hill & Clark LLP

(57) ABSTRACT

A collecting exhaust pipe has a contour body and partition wall members. The contour body has a pair of contour members connected with each other. The partition wall members are joined to the contour body and sandwiched between the contour members. A plurality of swelling portions, which are swelled toward the other contour member side, are formed on at least one of the contour members so as to form tubular undulations that extend continuously along a plurality of the primary exhaust pipes, and are shaped so as to join on the downstream side of the contour body on at least one outer surface of the contour body. The partition wall members extend from the upstream portion to the downstream side of the contour body, and are joined to the contour body at the location spaced from the top portions of the swelling portions.

20 Claims, 11 Drawing Sheets

EXHAUST DEVICE FOR MOTORCYCLE

BACKGROUND OF THE INVENTION

1. Field of the Invention

The present invention relates to an exhaust device for a motorcycle including a plurality of primary exhaust pipes, which are connected respectively to each of cylinders of a multi-cylinder engine body mounted on a body frame, and a collecting exhaust pipe which is commonly connected to the downstream end portion of the primary exhaust pipes.

2. Description of Related Art

As a collecting exhaust pipe, which is commonly connected to the downstream end portion of a plurality of primary exhaust pipes, the collecting exhaust pipe known in Japanese Utility Model Laid Open No. 62-731 is configured so as to join a main joint plate, which is configured such that two outer wall portions forming one-quarter, respectively, of the outer wall of the collecting exhaust pipe, are continuous and are integrally provided on both ends of a partition wall portion, with a pair of sub-joint plates constituting the rest of the outer wall of the collecting exhaust pipe.

Generally, it is desirable that the outer shape of a collecting exhaust pipe is formed so as to have a tubular shape apparently similar to a plurality of primary exhaust pipes, to extend continuously and respectively along each of the primary exhaust pipes, and to be formed with a tubular undulation in such a shape as to join on the downstream side in order to enhance its external appearance. However, in the collecting exhaust pipe disclosed in the above Japanese Utility Model, a partition wall portion has only to be disposed on the top portion of a swelling portion, which is swollen toward the inside of the collecting exhaust pipe out of the tubular undulation, and to be disposed in the center portion in the width direction of the collecting exhaust pipe, which thereby reduces the degree of freedom in disposition of the partition wall portions. Therefore, in the device set forth in Japanese Utility Model Laid Open No. 62-731 it is difficult to respond to the case where it is required to set the location in which the exhaust gas meets in the collecting exhaust pipe closer to the upstream side according to the characteristics of the vehicle. It is also possible to cause the increase in the number of parts due to the methods taken by connecting a collecting exhaust pipes and the like.

In addition, in the collecting exhaust pipe disclosed in the Japanese Utility Model mentioned above, the joining line of the main joint plate with two sub-joint plates undesirably occurs in the center portion in the width direction of a collecting exhaust pipe. Thus, it is required that a collecting exhaust pipe of the motorcycle has not only the function to cause the exhaust gas to meet inside an exhaust device so that the exhaust device constitutes a part of the vehicle external appearance, but also the functional beauty achieving such a smooth external design that the external flow passage shape from a plurality of primary exhaust pipes to secondary exhaust pipes (in smaller number than that of the primary exhaust pipes) or to an exhaust muffler is collected at parallel and equal spaces and then evenly collected. Accordingly, it is required to achieve the structure that can prevent the occurrence of the above-mentioned joint line.

SUMMARY OF THE INVENTION

The present invention has been realized in consideration of the above-described circumstances. Accordingly, it is an object of the present invention to provide an exhaust device for a motorcycle that increases the degree of freedom in disposition of partition wall members within a collecting exhaust pipe and prevents the joint line from occurring in the external appearance design of the collecting exhaust pipe.

According to the present invention, an exhaust device for a motorcycle includes a plurality of primary exhaust pipes, which are connected respectively to each of cylinders of a multi-cylinder engine body mounted on a body frame, and a collecting exhaust pipe, which is commonly connected to the downstream end portion of the primary exhaust pipes. The collecting exhaust pipe has a contour body, partition wall members, and a plurality of swelling portions. The contour body consists of a pair of contour members connected with each other so as to form therebetween an exhaust gas flow passage for circulating the exhaust gas guided from a plurality of the primary exhaust pipes. The partition wall members are joined to the contour body while being sandwiched between a pair of the contour members so as to divide the inside of the exhaust gas flow passage into at least two. The plurality of swelling portions are swelled to the other contour member side, are formed on at least one of a pair of the contour members, in order to form tubular undulations, which have tubular shape apparently similar to a plurality of the primary exhaust pipes, and are extending continuously and respectively along each of the primary exhaust pipes on at least one of outer surfaces of the contour body. The partition wall members are joined to the contour body at the location deviated from the top portions of the swelling portions and extend from the upstream portion to the downstream side of the contour body along an exhaust gas flow direction of the exhaust gas flow passage.

Accordingly, it is possible to dispose the partition wall members regardless of the position of the swelling portions, to freely design the exhaust gas flow passage in the collecting exhaust pipe, to increase the degree of freedom in disposition of the partition wall members in the collecting exhaust pipe, and to prevent the joint line from occurring on the appearance design of the collecting exhaust pipe.

In further accordance with the present invention, the partition wall members are respectively welded to both of the contour members so as to be welded to at least one of a pair of the contour members from inside of the contour body. Accordingly, it is possible to prevent the joint portion with the partition wall members from occurring on the outer surface on at least one of the contour members side out of the contour body, which thereby suppresses the disfigurement of the external appearance of the outer surface of the contour body on which the appearance design is applied so as to have the tubular undulations.

In further accordance with the present invention, the partition wall members are welded to one of a pair of the contour members from inside of the contour body and to the other of the contour members through welding holes, which are provided in the other contour member, from outside of the contour body. This facilitates joining the partition wall members to the contour body.

In further accordance with the present invention, the entire area of the portion, in which the welding holes are provided out of the other contour member, is formed in a flat plate shape. This not only can facilitate the welding operation, but also can enhance the bonding strength of the partition wall members to the contour body.

In further accordance with the present invention, the upstream and downstream end portions along the exhaust gas flow direction of a pair of the partition wall members are joined while forming a hollow portion between the intermediate portions of the partition wall members, and a pair of the partition wall members, which divide the exhaust gas flow passage into two branch flow passages, are joined to the contour body so as to be sandwiched between a pair of the contour members. Accordingly, it is possible to freely design the two branch flow passages, which can be obtained by partitioning the exhaust gas flow passage into two with the partition wall members, regardless of the undulating shape of the outer surface of the contour body.

In further accordance with the present invention, the downstream ends of a pair of the partition wall members are disposed in the middle of the contour body in the exhaust gas flow direction, which thereby can freely and easily design the manifold portion of the two branch flow passages in the collecting exhaust pipe.

In further accordance with the present invention, facing surfaces of the upstream end portion and the downstream end portion of a pair of the partition wall members are formed in a flat surface shape so as to abut on each other and to be jointed. Accordingly, it is possible to increase the airtightness of the joining portion of both partition wall members, and to smoothly circulate the exhaust gas to both sides of both partition wall members while preventing the exhaust gas from flowing in the hollow portion between both partition wall members.

In further accordance with the present invention, the downstream end portion of the collecting exhaust pipe is connected to a single exhaust muffler; an inner tube, which collects the exhaust gas of the exhaust gas flow passage and guides the exhaust gas into the exhaust muffler, is inserted in the downstream end portion of the contour body; and the upstream end portion of the inner tube is joined to the contour body. Thus, it is possible to make the downstream end portion of the collecting exhaust pipe into a double-layer pipe structure, and to smoothly guide the exhaust gas, which meets in the inner tube inserted in the downstream end portion of the collecting exhaust pipe, into the exhaust muffler.

In further accordance with the present invention, a boss member, which penetrates the contour body and the inner tube, is joined to the downstream end portion of the contour body; and a sensor mounting hole, whose outer end is opened outside and whose inner end is communicated into the inner tube, is formed in the boss member so that an exhaust gas sensor attached on the boss member is inserted in the sensor mounting hole. Accordingly it is possible to detect the exhaust gas circulating in the inner tube at the part of the double-layer pipe structure formed in the downstream end portion of the collecting exhaust pipe in case of using a single exhaust gas sensor.

BRIEF DESCRIPTION OF THE DRAWINGS

These and further features of the invention will be apparent from the following description and drawings, wherein.

DETAILED DESCRIPTION OF THE INVENTION

Hereinafter, the embodiment of the present invention will be described with reference to accompanying drawings. Incidentally, directions of up-and-down, left-and-right and front-and-rear in the description below are those seen from a rider riding on a motorcycle.

Figure 1:
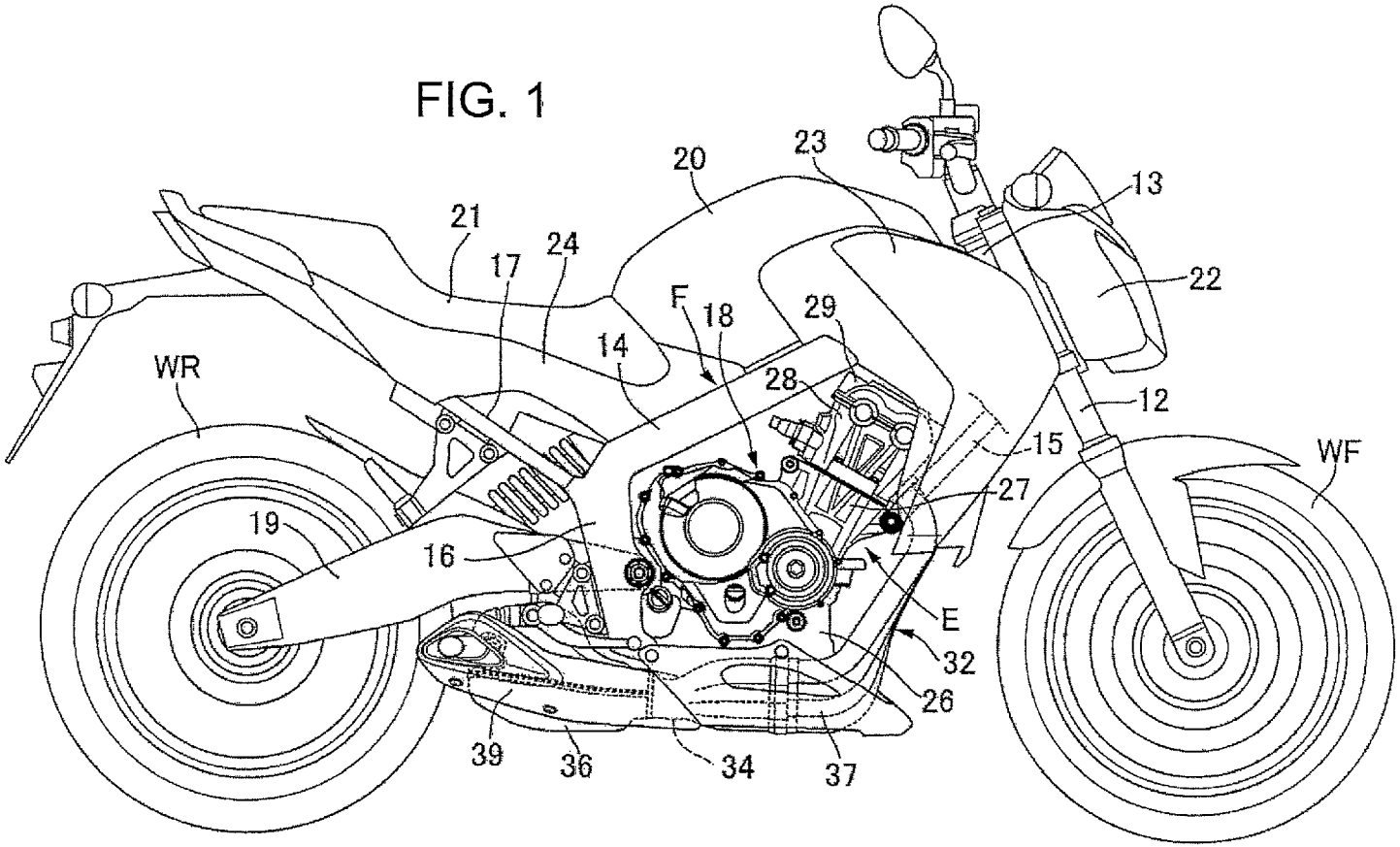
FIG. 1 is a side view of a motorcycle.

With reference to FIG. 1, a body frame F of a motorcycle includes a head pipe 13 which steerably supports a front fork 12 pivotally supporting a front wheel WF, left and right main frames 14 that extend downward to the rear direction from the head pipe 13, a single engine hanger 15 that extends downward to the rear direction from the head pipe 13 at a steeper angle than that of the main frames 14, left and right pivot frames 16 that extend downward from the rear portion of the main frames 14, and seat rails 17 that extend upward to the rear direction from the rear portion of the main frames 14. The main frames 14 and the pivot frames 16 are integrally formed.

An engine body 18 of a multi-cylinder, for example, four-cylinder engine E, which is disposed below the main frames 14, is supported at the rear portion of the main frames 14 of the body frame F, at the lower portion of the engine hanger 15 and at the lower portion of the pivot frames 16. In addition, the front end portion of a swing arm 19, which pivotally supports at the rear end portion thereof a rear wheel WR driven by the power developed by the engine E, is vertically swingably supported at the lower portion of the pivot frames 16. A fuel tank 20 is mounted on the main frames 14 above the engine E, and a rider seat 21, which is disposed behind the fuel tank 20, is supported by the seat rails 17.

The front fork 12 is covered from the front with a front cover 22, the lower portion on the front side of the fuel tank 20 and the front portion of the body frame F are covered from both sides with left and right front side covers 23, the lower side of the rear portion of the fuel tank 20 and the rear portion of the body frame F is covered from both sides with left and right rear side covers 24, which are disposed below the rider seat 21.

Figure 2:
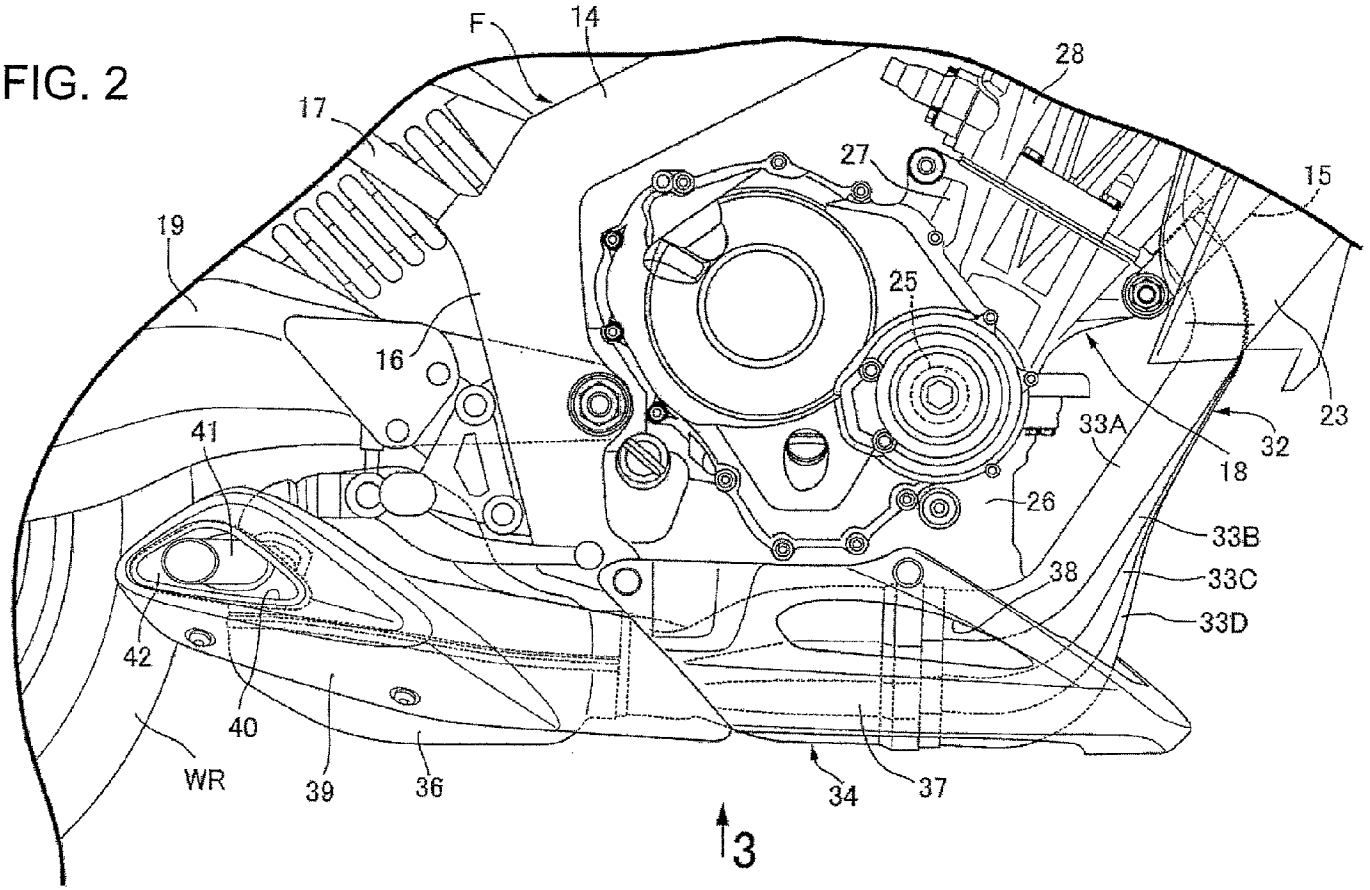
FIG. 2 is an enlarged view of a main part of FIG. 1.

Referring also to FIG. 2, the engine body 18 of the engine E has a crankcase 26, which rotatably supports a crankshaft 25 having the axis extending in the width direction of the body frame F, a cylinder block 27, which is jointed to the upper end of the front portion of the crankcase 26 with the cylinder axis inclined frontward, a cylinder head 28, which is jointed to the upper end of the cylinder block 27, and a head cover 29 (see FIG. 1), which is jointed to the upper end of the cylinder head 28, and is configured with, for example, in-line four cylinders.

Figure 3:
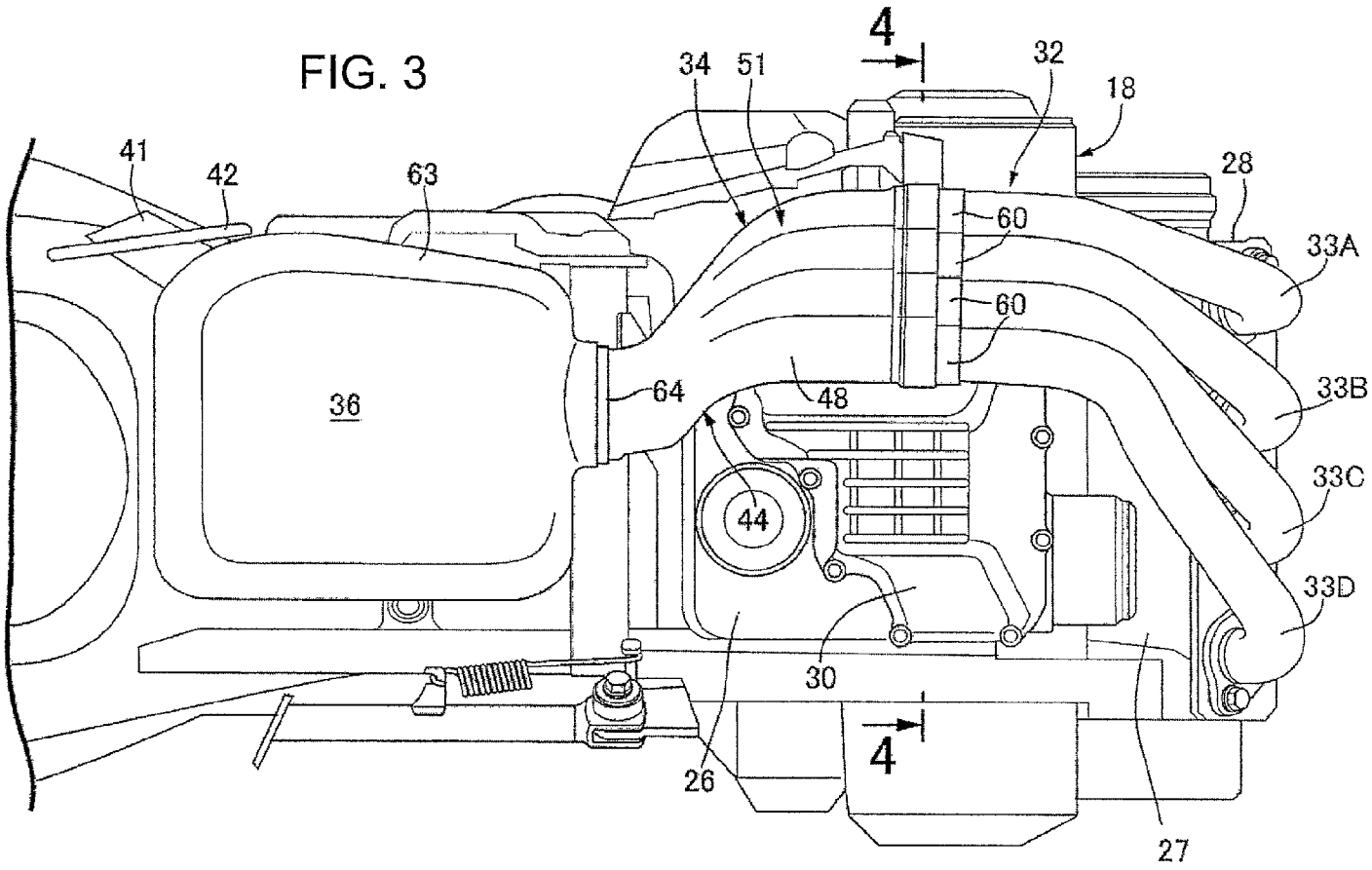
FIG. 3 is a view taken in the direction shown by an arrow 3 of FIG. 2 without an exhaust pipe cover and a muffler protector.

Referring also to FIG. 3, an exhaust device 32, which is connected to the side surface of the front portion of the cylinder head 28, comprises a plurality of primary exhaust pipes 33A, 33B, 33C, 33D, the upstream ends of which are connected to the side surface of the front portion of the cylinder head 28, a collecting exhaust pipe 34, which is commonly connected to the downstream end portion of the primary exhaust pipes 33A-33D, and an exhaust muffler 36, which is connected to the downstream end portion of the collecting exhaust pipe 34 so as to be disposed at the downstream end of the exhaust device 32. The exhaust muffler 36 is disposed on the forward and the right side of the rear wheel WR.

In the embodiment of the present invention, since the engine body 18 is configured with four cylinders, the four primary exhaust pipes 33A-33D are connected to the side surface of the front portion of the cylinder head 28 so as to respectively correspond to each of the cylinders, and the number of a secondary exhaust pipe 35 is set to be one.

Figure 4:
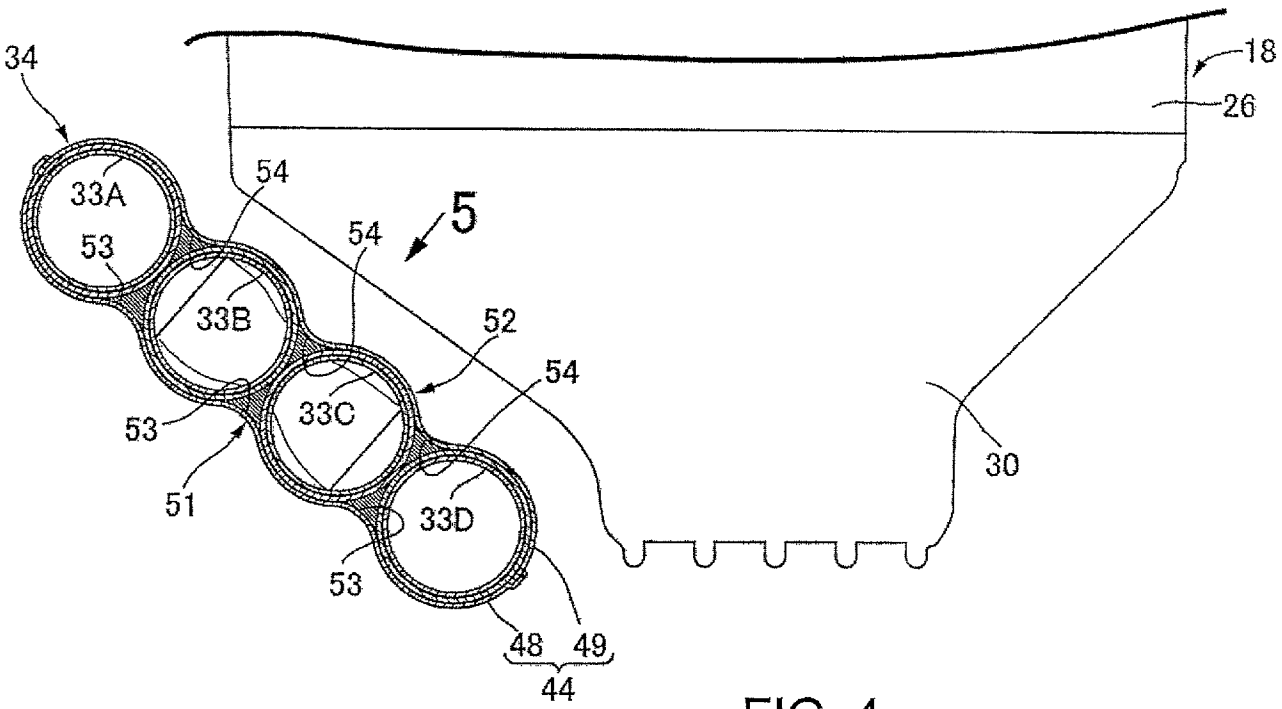
FIG. 4 is a sectional view taken along a line 4-4 of FIG. 3.

Referring also to FIG. 4, an oil pan 30 is joined to the lower portion of the crankcase 26, and the four primary exhaust pipes 33A-33D are formed to bend in such a way to extend downward from the side surface of the front portion of the cylinder head 28 and to extend rearward while passing along the right side of the oil pan 30. While passing the right side of the oil pan 30, the primary exhaust pipes 33A-33D are arranged so as to collect in parallel while the primary exhaust pipes are inclined so as to be located upward as they approach the outside in the width direction of the vehicle. In addition, the collecting exhaust pipe 34 is disposed on the right side of the oil pan 30 and are commonly connected to the downstream end portion of the four primary exhaust pipes 33A-33D.

The downstream end portion, which is disposed below the crankcase 26 out of the primary exhaust pipes 33A-33D, and the collecting exhaust pipe 34 are covered from the right side with an exhaust pipe cover 37 having a first opening 38, from which a part of the connecting portion of the primary exhaust pipes 33A-33D with the collecting exhaust pipe 34 is exposed (FIG. 2). The exhaust pipe cover 37 is supported by the crankcase 26 and the pivot frame 16 on the right side. In addition, the majority of the exhaust muffler 36 is covered from the right side with a muffler protector 39, which is disposed so as to be continuous to the rear portion of the exhaust pipe cover 37, and a tail pipe 41 of the exhaust muffler 36 is disposed in a second opening 40, which is provided in the muffler protector 39. A cap member 42 is attached to the tail pipe 41 so as to close the second opening 40 from inside.

Referring also to FIGS. 5-9, the collecting exhaust pipe 34 has a contour body 44, which consists of first and second contour members 48, 49 connected with each other so as to form therebetween an exhaust gas flow passage 47 for circulating the exhaust gas guided from the four primary exhaust pipes 33A-33D, and a pair of partition wall members 45, 46, which are jointed to a contour body 44 while being sandwiched between the first and second contour members 48, 49 so as to divide the inside of the exhaust gas flow passage 47 into at least two.

The first and second contour members 48, 49 are joined with each other in such an inclined posture as to be located upward as they approach the outside in the width direction of the vehicle on the right side of the oil pan 30. The first and second contour members 48, 49 are joined such that the circumferential portion of the second contour member 49, which is disposed inside in the width direction of the vehicle, is fitted in the circumferential portion of the first contour member 48, which is disposed outside in the width direction of the vehicle. With such configuration, in response to the fact that the primary exhaust pipes 33A-33D are arranged in parallel while being inclined so as to be oriented or located upward as they approach the outside in the width direction on the right side of the oil pan 30, the contour body 44 is disposed on the right side of the oil pan 30 while the contour body is inclined so as to be located or oriented upward as it approaches the outside in the width direction of the vehicle.

A plurality of (three for each in the embodiment of the present invention) swelling portions 53, 54, which are swelled to the other side, are formed on at least one of the first and second contour members 48, 49 (on both of the first and second contour members 48, 49 in the embodiment of the present invention), in order to form first and second tubular undulations 51, 52, which have a tubular shape apparently similar to the four primary exhaust pipes 33A-33D. The first and second tubular undulations 51, 42 extend continuously and respectively along each of the primary exhaust pipes 33A-33D on at least one outer surface of the contour body 44 (on both outer surfaces on the outside and the inside in the width direction of the vehicle of the contour body 44 in the embodiment of the present invention).

The first tubular undulation 51, which is formed on the outer surface on the outside in the width direction of the vehicle of the contour body 44, spans from the upstream end to the downstream end portion of the contour body 44 in an exhaust gas flow direction 50 within the exhaust gas flow passage 47, and is formed so as to have a shape joining on the downstream side. The three swelling portions 53, which are swelled to the second contour member 49 side, are formed on the first contour member 48 in order to form the first tubular undulation 51.

The second tubular undulation 52, which is formed on the outer surface on the inside in the width direction of the vehicle of the contour body 44, is formed corresponding only to the upstream side of the exhaust gas flow direction 50 out of the first tubular undulation 51. The three swelling portions 54, which are swelled to the first contour member 48 side, are formed on the upstream side of the second contour member 49 in the exhaust gas flow direction 50 in order to form the second tubular undulation 52.

A pair of the partition wall members 45, 46 are joined to the contour body 44 at the location spaced or deviated from a top portion 53*a* of the swelling portion 53 of the first contour member 48 and a top portion 54*a* of swelling portion 54 of the second contour member 49, and extend from the upstream portion to the downstream portion of the contour body 44.

The upstream end and the downstream end along the exhaust gas flow direction 50 of a pair of the partition wall members 45, 46 are joined with each other, and a hollow portion 55 is formed between the intermediate portions along the exhaust gas flow direction 50 of both of the partition wall members 45, 46. The partition wall members 45, 46, which divide the exhaust gas flow passage 47 into two branch flow passages 56, 57, are joined to the contour body 44 so as to be sandwiched between the first and second contour members 48, 49.

Facing surfaces 45*a*, 45*b*; 46*a*, 46*b* of the upstream end portion and the downstream end portion of the pair of the partition wall members 45, 46 are formed in a flat surface shape so as to abut on each other and to be joined. The downstream ends of both partition wall members 45, 46 are disposed in the middle of the contour body 44 in the exhaust gas flow direction 50.

The pair of the partition wall members 45, 46 are respectively welded to the first and second contour members 48, 49 so as to be welded to at least one of the first and second contour members 48, 49 from inside of the contour body 44. In the embodiment of the present invention, both partition wall members 45, 46 are welded to the first contour member 48 from inside of the contour body 44, and are welded to the second contour member 49 through welding holes 58, 59, which are provided in the second contour member 49, from outside of the contour body 44.

Figure 9:
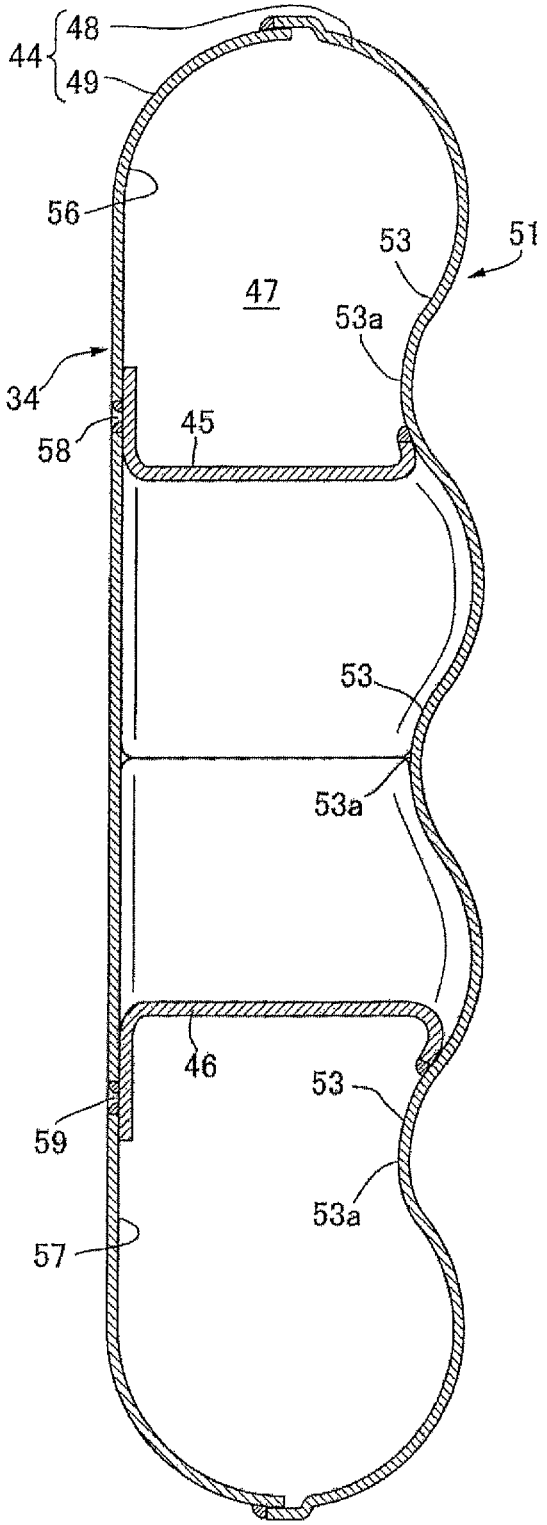
FIG. 9 is a sectional view taken along a line 9-9 of FIG. 5.

The welding holes 58, 59 are formed in a curved shape so as to avoid the top portion 54*a* of the swelling portion 54 provided on the second contour member 49, and the entire area of the portion, in which the welding holes 58, 59 are provided out of the second contour member 49, is formed in a flat plate shape as shown in FIG. 9.

Four connecting pipes 60, which correspond to four primary exhaust pipes 33A-33D, are joined to the upstream end portion of the contour body 44 such that a part of the connecting pipes 60 is fitted in the upstream end portion of the contour body 44. The downstream end portion of the primary exhaust pipes 33A-33D fit into the connecting pipes 60, and the primary exhaust pipes 33A-33D are welded to the connecting pipes 60. Further, the area between the connecting pipes 60, 60 is treated with building up welding so as not to have an opening hole leading into the contour body 44.

Figure 5:
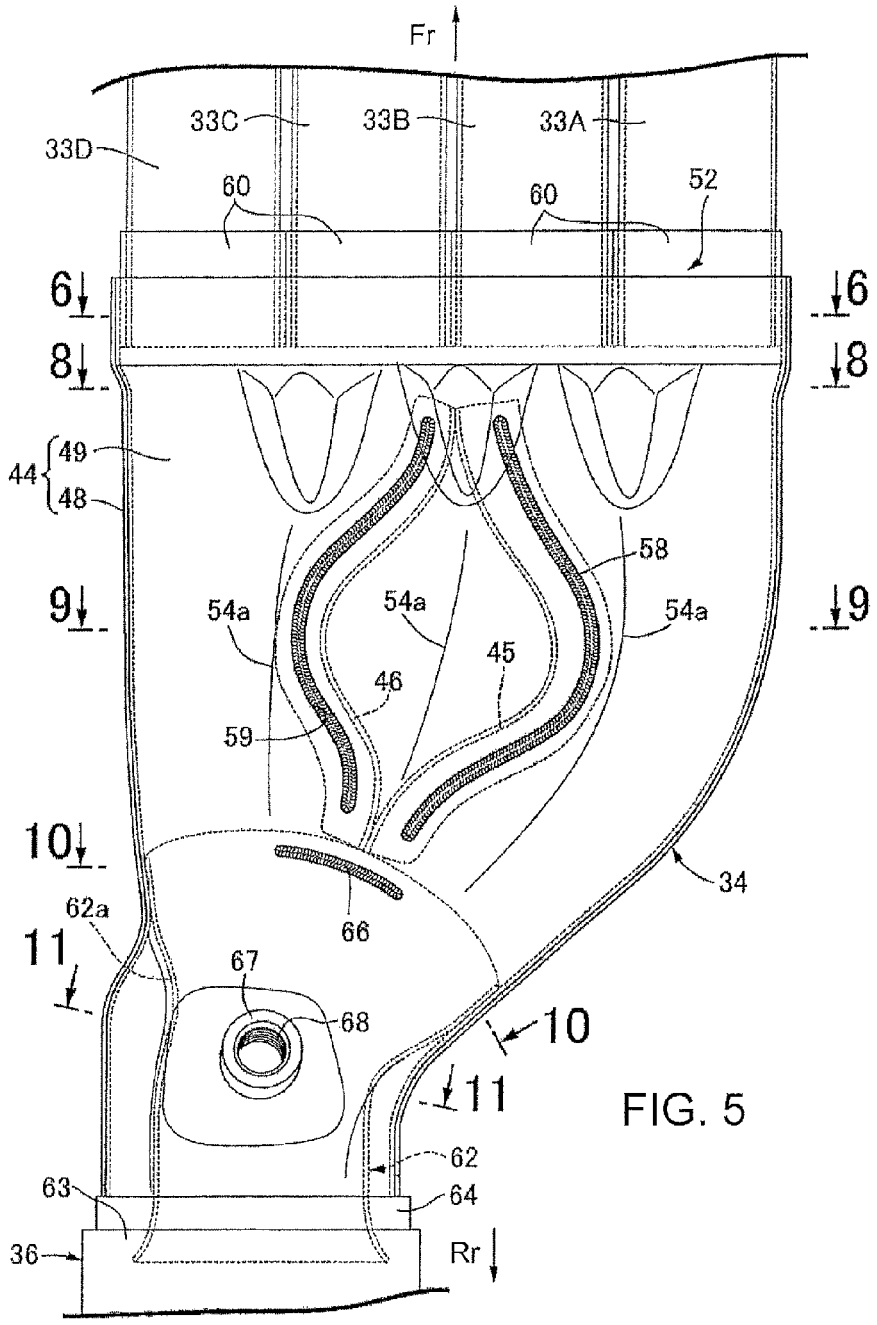
FIG. 5 is a view of a collecting exhaust pipe taken in the direction shown by an arrow 5 of FIG. 4.
Figure 6:
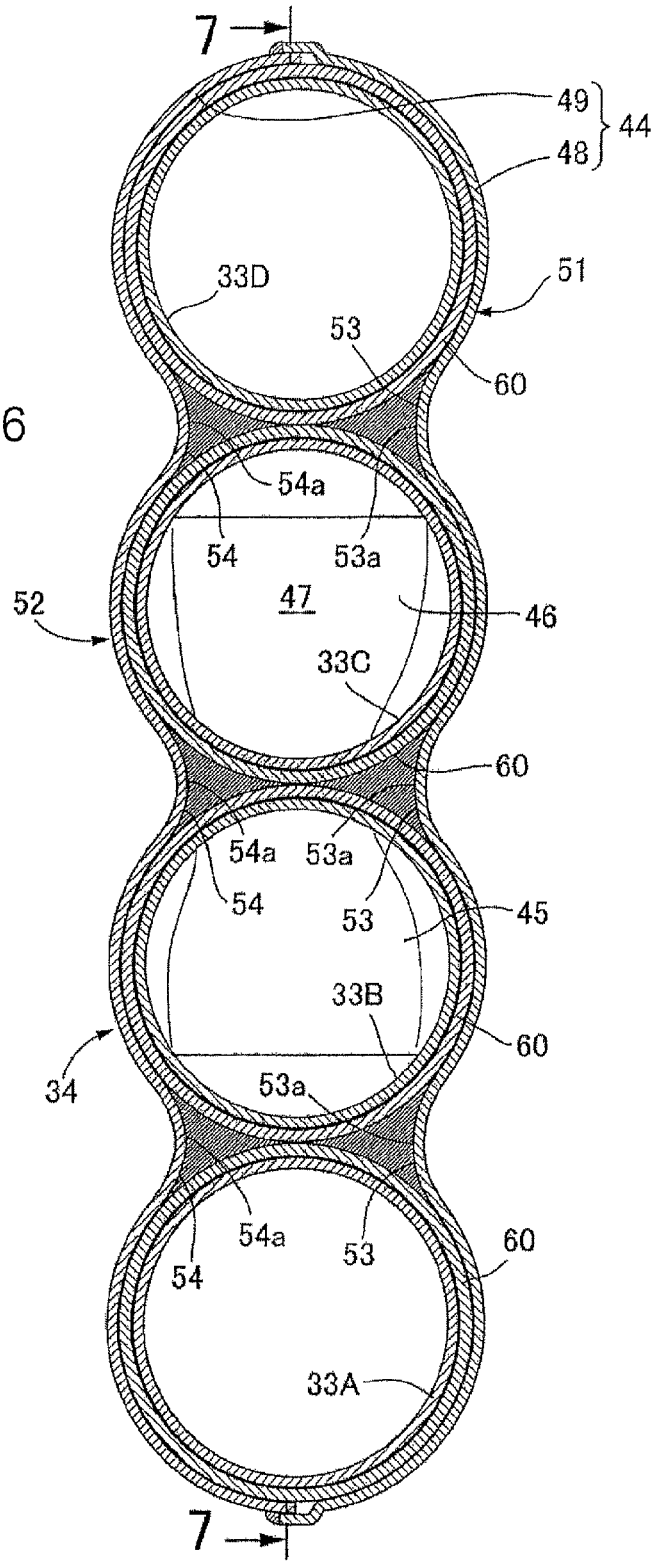
FIG. 6 is a sectional view taken along a line 6-6 of FIG. 5.
Figure 7:
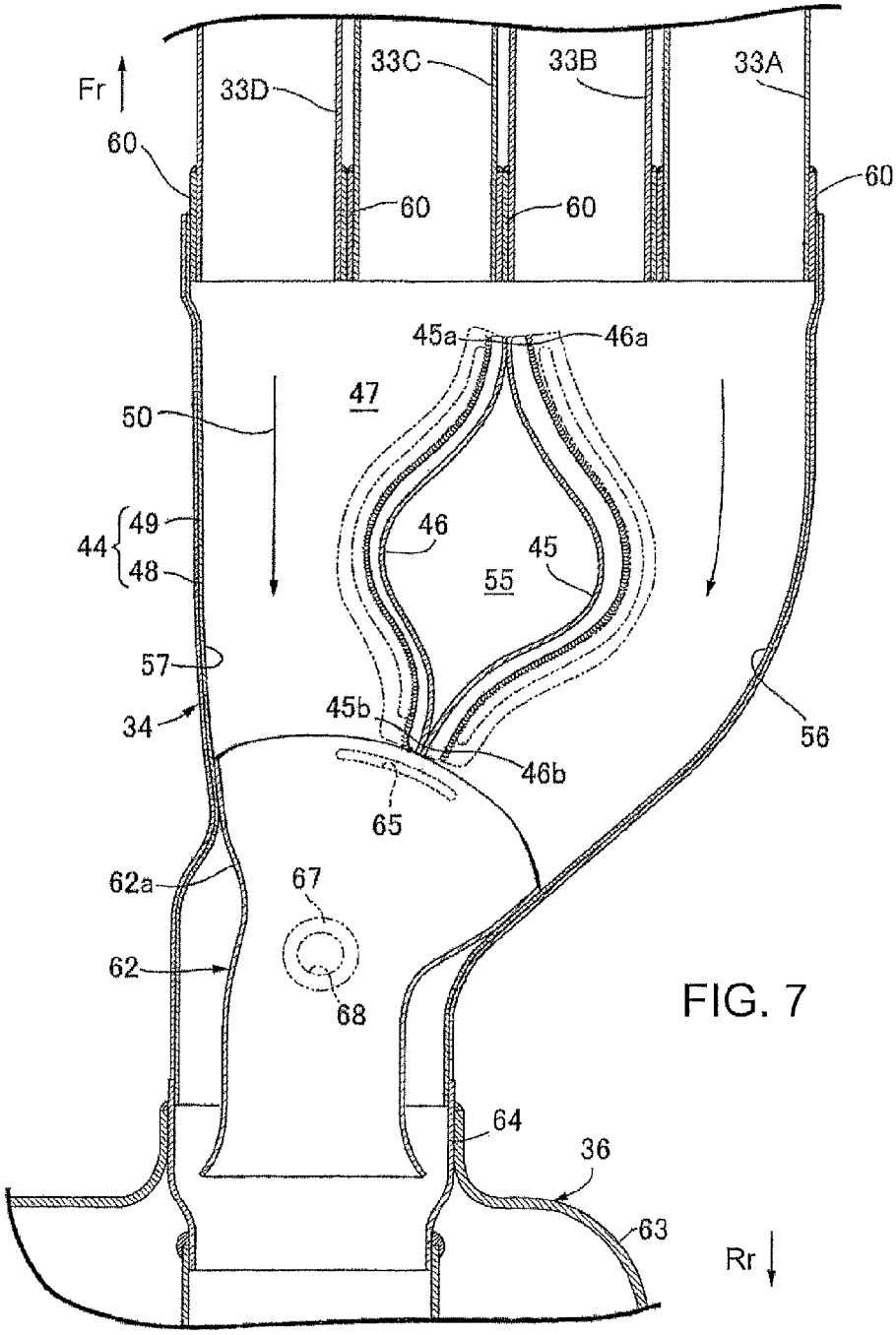
FIG. 7 is a sectional view taken along a line 7-7 of FIG. 6.
Figure 8:
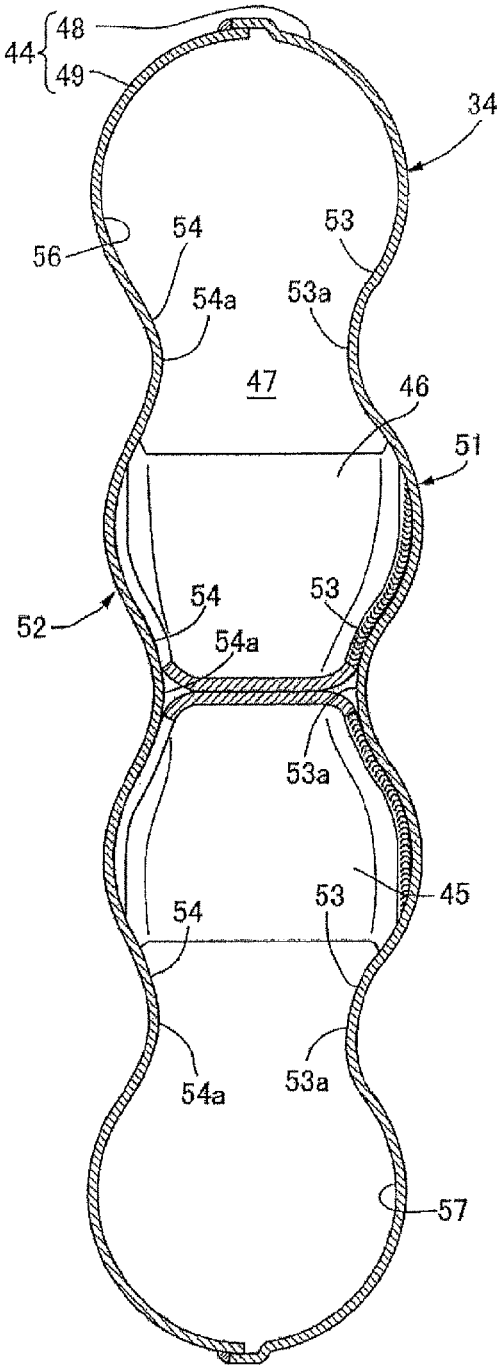
FIG. 8 is a sectional view taken along a line 8-8 of FIG. 5.

With reference to FIGS. 5 and 7, the downstream end portion of the collecting exhaust pipe 34 is connected to the single exhaust muffler 36, such that the downstream end portion of the contour body 44 is fixedly attached to a case 63 of the exhaust muffler 36 and is fitted in a connecting pipe 64 that partially protrudes from the case 63.

Figure 10:
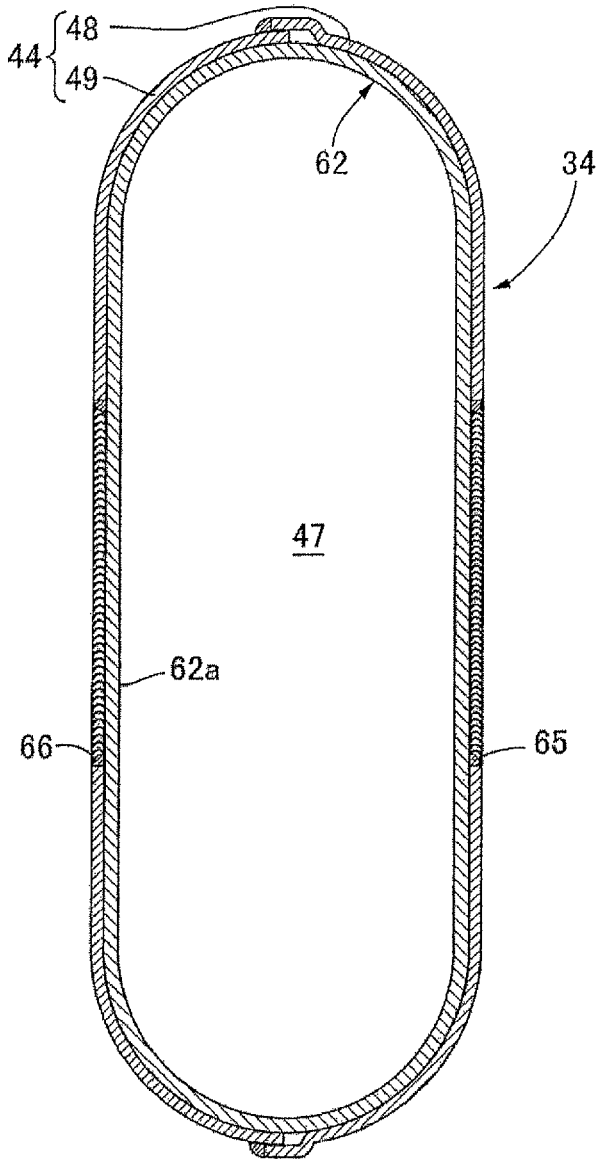
FIG. 10 is a sectional view taken along a line 10-10 of FIG. 5.

Referring also to FIG. 10, an inner tube 62, which collects the exhaust gas of the exhaust gas flow passage 47 and guides the exhaust gas into the exhaust muffler 36, is inserted in the downstream end portion of the contour body 44.

The upstream side of the inner tube 62 is formed as an expansion portion 62*a*, which is expanded as it approaches the upstream side, and the upstream end of the expansion portion 62*a* abuts on the inner surface of the contour body 44. The upstream end portion of the inner tube 62, that is, the upstream end portion of the expansion portion 62*a*, is joined to the contour body 44 of the collecting exhaust pipe 34. Welding holes 65, 66 in an elongated hole shape are provided respectively on the first and second contour members 48, 49 at the downstream end portion of the contour body 44 in order to join the inner tube 62. And the inner tube 62 is welded to the contour body 44 through the welding holes 65, 66.

Figure 11:
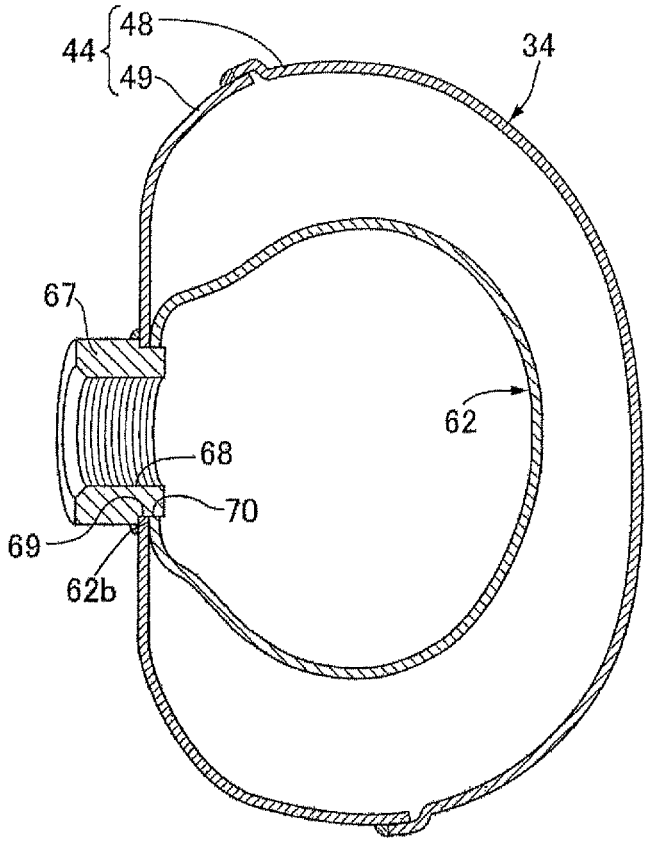
FIG. 11 is a sectional view taken along a line 11-11 of FIG. 5.

In FIG. 11, a boss member 67, which penetrates the contour body 44 and the inner tube 62, is joined to the downstream end portion of the contour body 44. Namely, an abutting portion 62*b*, which swells so as to abut on the inner surface of the second contour member 49 of the contour body 44, is formed on the intermediate portion of the inner tube 62 along the exhaust gas flow direction 50. The cylindrical boss member 67, which is inserted in an insert hole 69 provided in the second contour member 49 as well as in an insert hole 70 provided in the abutting portion 62*b* so as to correspond to the insert hole 69, is welded on the outer surface of the second contour member 49.

A sensor mounting hole 68, whose outer end is opened outside and whose inner end is communicated into the inner tube 62, is formed in the boss member 67, so that an exhaust gas sensor attached on the boss member 67 is inserted in the sensor mounting hole 68.

Next, an explanation will be given of the operation of the embodiment. The collecting exhaust pipe 34 has the contour body 44, which consists of the first and second contour members 48, 49 connected with each other so as to form therebetween the exhaust gas flow passage 47 for circulating the exhaust gas guided from the four primary exhaust pipes 33A-33D, and a pair of the partition wall members 45, 46, which are joined to the contour body 44 while being sandwiched between the first and second contour members 48, 49 so as to divide the inside of the exhaust gas flow passage 47 into at least two. A plurality of the swelling portions 53, 54, which are swelled to the other contour member side, are formed on at least one (on both in the embodiment of the present invention) of the first and second contour members 48, 49, in order to form the tubular undulations 51, 52, which have a tubular shape apparently similar to the four primary exhaust pipes 33A-33D. The tubular undulations 51, 42 extend continuously and respectively along each of the primary exhaust pipes 33A-33D on at least one of outer surfaces (on both outer surfaces in the embodiment of the present invention) of the contour body 44. The partition wall members 45, 46 are joined to the contour body 44 at the location deviated or spaced from the top portions 53*a*, 54*a* of the swelling portions 53, 54. Accordingly, it is possible to dispose or locate the partition wall members 45, 46 without regard to the position of the swelling portions 53, 54, to freely design the exhaust gas flow passage 47 in the collecting exhaust pipe 34, to increase the degree of freedom in disposition of the partition wall members 45, 46 in the collecting exhaust pipe 34, and to prevent the joint line from occurring on the appearance design of the collecting exhaust pipe 34.

In addition, the partition wall members 45, 46 are welded to the first and second contour members 48, 49, respectively, so as to be welded to at least one (the first contour member in the embodiment of the present invention) of the first and second contour members 48, 49 from inside of the contour body 44. Accordingly, it is possible to prevent the joint portion with the partition wall members 45, 46 from occurring on the outer surface on at least one of the contour members (the first contour member 48 in the embodiment of the present invention) side out of the contour body 44, which thereby suppresses the disfigurement of the external appearance of the outer surface of the contour body 44 on which the appearance design is applied so as to have the tubular undulations.

In addition, the partition wall members 45, 46 are welded to the first contour member 48 out of the first and second contour members 48, 49 from inside of the contour body 44 and to the second contour member 49 through the welding holes 58, 59, which are provided in the second contour member 49, from outside of the contour body 44, which thereby facilitate joining the partition wall members 45, 46 to the contour body 44.

In addition, the entire area of the portion, in which the welding holes 58, 59 are provided out of the second contour member 49, is formed in a flat plate shape, which thereby not only can facilitate the welding operation, but also can enhance the bonding strength of the partition wall members 45, 46 to the contour body 44.

In addition, the upstream and downstream ends along the exhaust gas flow direction 50 of the exhaust gas flow passage 47 are joined with each other forming the hollow portion 55 between the intermediate portions of the partition wall members, and the pair of the partition wall members 45, 46, which divide the exhaust gas flow passage 47 into the two branch flow passages 56, 57, are joined to the contour body 44 so as to be sandwiched between the first and second contour members 48, 49. Accordingly, it is possible to freely design the two branch flow passages 56, 57, which can be obtained by partitioning the exhaust gas flow passage 47 into two with the partition wall members 45, 46, regardless of undulating shape of the outer surface of the contour body 44.

In addition, the downstream ends of the pair of the partition wall members 45, 46 are disposed in the middle of the contour body 44 in the exhaust gas flow direction 50, which thereby can freely and easily design the manifold portion of the two branch flow passages 56, 57 in the collecting exhaust pipe 34.

In addition, the facing surfaces 45*a*, 45*b*; 46*a*, 46*b* of the upstream end portion and the downstream end portion of the pair of the partition wall members 45, 46 are formed in a flat plate shape so as to abut on each other and to be jointed. Accordingly, it is possible to increase the airtightness of the joining portion of both partition wall members 45, 46, and to smoothly circulate the exhaust gas to both sides of both partition wall members 45, 46 while preventing the exhaust gas from flowing in the hollow portion 55 between both partition wall members 45, 46.

In addition, the downstream end portion of the collecting exhaust pipe 34 is connected to the single exhaust muffler 36, the inner tube 62, which collects the exhaust gas of the exhaust gas flow passage 47 and guides the exhaust gas into the exhaust muffler 36, is inserted in the downstream end portion of the contour body 44, and the upstream end portion of the inner tube 62 is jointed to the contour body 44. Accordingly, it is possible to make the downstream end portion of the collecting exhaust pipe 34 into a double-layer pipe structure, and to smoothly guide the exhaust gas, which meets in the inner tube inserted in the downstream end portion of the collecting exhaust pipe 34, into the exhaust muffler 36.

Further, the boss member 67, which penetrates the contour body 44 and the inner tube 62, is joined to the downstream end portion of the contour body 44, and the sensor mounting hole 68, whose outer end is opened outside and whose inner end is communicated into the inner tube 62, is formed in the boss member 67 so that the exhaust gas sensor attached on the boss member 67 is inserted in the sensor mounting hole. Accordingly, it is possible to detect the exhaust gas circulating in the inner tube 62 at the part of the double-layer pipe structure formed in the downstream end portion of the collecting exhaust pipe 34 in case of using a single exhaust gas sensor.

Having thus described the specific embodiment of the present invention, the present invention is not limited to the above-described preferred embodiment. Various changes in design may be made without departing from the spirit and scope of the invention as defined in the claims.

DESCRIPTION OF REFERENCE NUMERALS

18 . . . engine body
33A, 33B, 33C, 33D . . . primary exhaust pipe
34 . . . collecting exhaust pipe
44 . . . exhaust muffler
44 . . . contour body
47 . . . exhaust gas flow passage
48, 49 . . . contour member
45, 46 . . . partition wall member
45*a*, 45*b*; 46*a*, 46*b* . . . facing surface
50 . . . exhaust gas flow direction
51, 52 . . . tubular undulation
53, 54 . . . swelling portion
53*a*, 54*a* . . . top portion
55 . . . hollow portion
56, 57 . . . branch flow passage
58, 59 . . . welding hole
62 . . . inner tube
67 . . . boss member
68 . . . sensor mounting hole
F . . . body frame

What is claimed is:

1. In an exhaust device for a motorcycle comprising:

a plurality of primary exhaust pipes, which are respectively connected to each cylinder of a multi-cylinder engine body mounted on a body frame, and a collecting exhaust pipe, which is commonly connected to the downstream end portion of the primary exhaust pipes, wherein said collecting exhaust pipe has a contour body, which consists of a pair of contour members connected with each other so as to form therebetween an exhaust gas flow passage for circulating the exhaust gas guided from a plurality of said primary exhaust pipes, partition wall members, which are joined to said contour body while being sandwiched between a pair of said contour members so as to divide the inside of said exhaust gas flow passage into at least two, a plurality of swelling portions are formed in each of said pair of contour members, said swelling portions are swelled toward said other contour member in order to form tubular undulations having a tubular shape apparently similar to the plurality of said primary exhaust pipes and extend continuously and respectively along each of the primary exhaust pipes on at least one of outer surfaces of said contour body and, said partition wall members are joined to said contour body at a location spaced from top portions of said swelling portions and extend from the upstream portion to a downstream side of said contour body along an exhaust gas flow direction of said exhaust gas flow passage.

2. The exhaust device for the motorcycle, according to claim 1, wherein said partition wall members are welded to both of the contour members and are welded to at least one of said contour members from inside of said contour body.

3. The exhaust device for the motorcycle, according to claim 2, wherein said partition wall members are welded to one said contour members from inside of said contour body and to the other of said contour members through welding holes, which are provided in the other contour member, from outside of said contour body.

4. The exhaust device for the motorcycle, according to claim 3, wherein an entire area of the portion of the other contour member in which said welding holes are provided is formed in a flat plate shape.

5. The exhaust device for the motorcycle, according to claim 1, wherein the upstream and downstream end portions along said exhaust gas flow direction of a pair of said partition wall members are joined while forming a hollow portion between the intermediate portions of the partition wall members, and a pair of said partition wall members, which divide said exhaust gas flow passage into two branch flow passages, are joined to said contour body so as to be sandwiched between the pair of contour members.

6. The exhaust device for the motorcycle, according to claim 5, wherein the downstream ends of said pair of said partition wall members are disposed in a middle of said contour body in said exhaust gas flow direction.

7. The exhaust device for the motorcycle, according to claim 5, wherein facing surfaces of the upstream end portion and the downstream end portion of said pair of said partition wall members are formed in a flat surface shape so as to abut on each other and to be joined.

8. The exhaust device for the motorcycle, according to claim 1, wherein a downstream end portion of said collecting exhaust pipe is connected to a single exhaust muffler, an inner tube, which collects exhaust gas of said exhaust gas flow passage and guides the exhaust gas into said exhaust muffler, is inserted in a downstream end portion of said contour body, and an upstream end portion of the inner tube is joined to said contour body.

9. The exhaust device for the motorcycle, according to claim 8, wherein a boss member, which penetrates the contour body and said inner tube, is joined to the downstream end portion of said contour body and, a sensor mounting hole, whose outer end is opened outside and whose inner end is communicated into said inner tube, is formed in the boss member so that an exhaust gas sensor attached on said boss member is inserted in the sensor mounting hole.

10. The exhaust device for the motorcycle, according to claim 2, wherein the upstream and downstream end portions along said exhaust gas flow direction of a pair of said partition wall members are joined while forming a hollow portion between the intermediate portions of the partition wall members, and a pair of said partition wall members, which divide said exhaust gas flow passage into two branch flow passages, are joined to said contour body so as to be sandwiched between the pair of contour members.

11. The exhaust device for the motorcycle, according to claim 10, wherein the downstream ends of said pair of said partition wall members are disposed in a middle of said contour body in said exhaust gas flow direction.

12. The exhaust device for the motorcycle, according to claim 10, wherein facing surfaces of the upstream end portion and the downstream end portion of said pair of said partition wall members are formed in a flat surface shape so as to abut on each other and to be joined.

13. The exhaust device for the motorcycle, according to claim 11, wherein facing surfaces of the upstream end portion and the downstream end portion of said pair of said partition wall members are formed in a flat surface shape so as to abut on each other and to be joined.

14. The exhaust device for the motorcycle, according to claim 3, wherein the upstream and downstream end portions along said exhaust gas flow direction of a pair of said partition wall members are joined while forming a hollow portion between the intermediate portions of the partition wall members, and a pair of said partition wall members, which divide said exhaust gas flow passage into two branch flow passages, are joined to said contour body so as to be sandwiched between the pair of contour members.

15. The exhaust device for the motorcycle, according to claim 14, wherein the downstream ends of said pair of said partition wall members are disposed in a middle of said contour body in said exhaust gas flow direction.

16. The exhaust device for the motorcycle, according to claim 14, wherein facing surfaces of the upstream end portion and the downstream end portion of said pair of said partition wall members are formed in a flat surface shape so as to abut on each other and to be joined.

17. The exhaust device for the motorcycle, according to claim 15, wherein facing surfaces of the upstream end portion and the downstream end portion of said pair of said partition wall members are formed in a flat surface shape so as to abut on each other and to be joined.

18. The exhaust device for the motorcycle, according to claim 4, wherein the upstream and downstream end portions along said exhaust gas flow direction of a pair of said partition wall members are joined while forming a hollow portion between the intermediate portions of the partition wall members, and a pair of said partition wall members, which divide said exhaust gas flow passage into two branch flow passages, are joined to said contour body so as to be sandwiched between the pair of contour members.

19. The exhaust device for the motorcycle, according to claim 18, wherein the downstream ends of said pair of said partition wall members are disposed in a middle of said contour body in said exhaust gas flow direction.

20. The exhaust device for the motorcycle, according to claim 18, wherein facing surfaces of the upstream end portion and the downstream end portion of said pair of said partition wall members are formed in a flat surface shape so as to abut on each other and to be joined.

* * * * *